US005793402A

United States Patent [19]

Sadaki et al.

[11] Patent Number: 5,793,402

[45] Date of Patent: Aug. 11, 1998

[54] THERMAL TRANSFER RECORDING METHOD AND APPARATUS OF BOTH SUBLIMATION TYPE AND FUSION TYPE

[75] Inventors: Akihiro Sadaki; Masayoshi Shiraishi; Naoki Kawawada; Koji Kawaguchi, all of Tokyo, Japan

[73] Assignee: Seiko Instruments Inc., Tokyo, Japan

[21] Appl. No.: 556,628

[22] Filed: Nov. 13, 1995

Related U.S. Application Data

[63] Continuation-in-part of Ser. No. 64,558, May 21, 1993, Pat. No. 5,467,120.

[30] Foreign Application Priority Data

May 25, 1992 [JP] Japan ..... 4-132550
May 29, 1992 [JP] Japan ..... 4-138592

[51] Int. Cl.[6] ..... B41J 2/32; B41J 2/325; B41J 11/42; B41J 2/335

[52] U.S. Cl. ..... 347/171; 347/218

[58] Field of Search ..... 347/200, 171, 347/206, 215, 218; 400/120.01

[56] References Cited

U.S. PATENT DOCUMENTS 4,980,698 12/1990 Inoue ..... 347/200
5,467,120 11/1995 Sadaki et al. ..... 347/171

*Primary Examiner*—Huan H. Tran
*Attorney, Agent, or Firm*—Loeb & Leob LLP

[57] ABSTRACT

An image recording method and apparatus employing a thermal head capable of making a sublimation type thermal transfer recording and a fusion type thermal transfer recording by means of the same thermal head. This apparatus sets its vertical printing pitch at different values in the sublimation type recording mode and the fusion type recording mode. In the sublimation type recording mode, after making a first printing, this apparatus feeds a recording paper by a distance which is an integral multiple of the vertical printing pitch and makes a second printing using the same printing data as the first printing. In the fusion type recording mode, after making a 1-line printing, this apparatus feeds the recording paper by a 1-line spacing and makes a printing by means of printing data of the next line.

10 Claims, 15 Drawing Sheets

FIG. 6(a) FIG. 6(c)
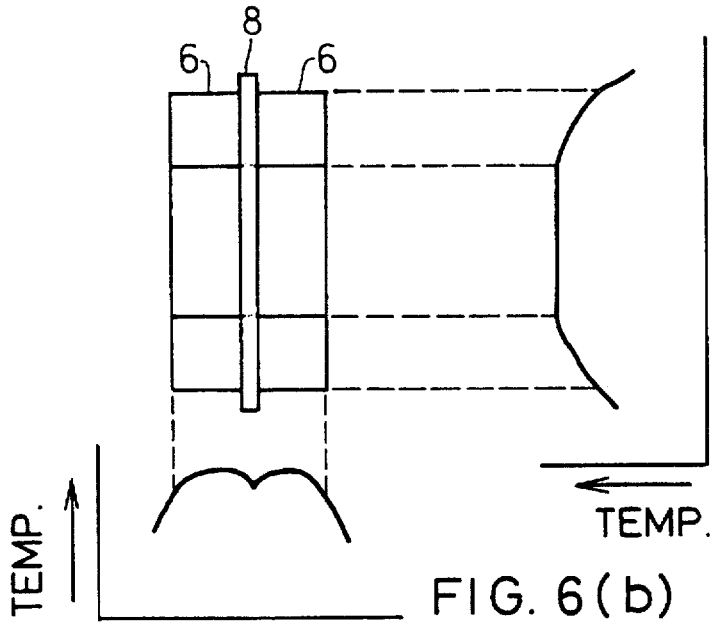
FIG. 6(b)
FIG. 7(a) FIG. 7(c)
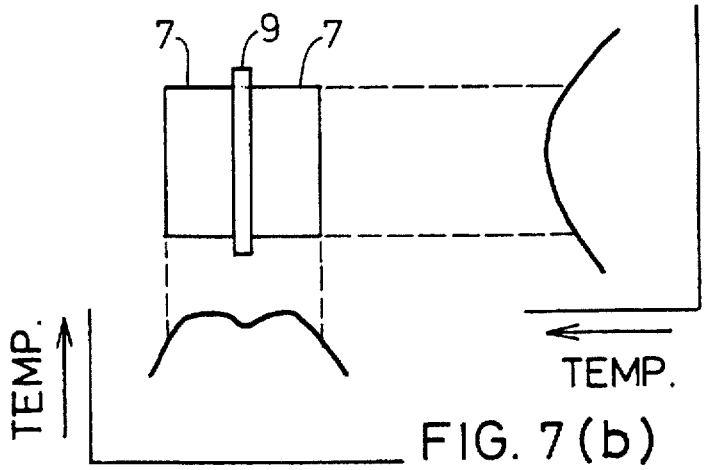
FIG. 7(b)

VERTICAL SCANNING DIRECTION
HORIZONTAL SCANNING DIRECTION
PRINTING PITCH

101
D0
D1
D2
D3
103
Q1
Q2
Q3
Q4
P1
P2
P3
P4
P=Q
a
104
LD
b
c
107
LD RC
ROM
106
108
105
Q
Q̄
D
CLR
h
d
f
e
g
PRINTING PULSE
LINE CLOCK
CLOCK
ENABLE

THERMAL TRANSFER RECORDING METHOD AND APPARATUS OF BOTH SUBLIMATION TYPE AND FUSION TYPE

CROSS-REFERENCE TO RELATED APPLICATION

This is a continuation-in-part of U.S. application Ser. No. 08/064,558, filed on May 21, 1993 now U.S. Pat. No. 5,467,120.

BACKGROUND OF THE INVENTION

The present invention relates to an image recording method by means of ink thermal transfer, and particularly to a thermal transfer recording method and apparatus which can give a preferred halftone image by means of ink thermal transfer of both sublimation type and fusion type.

Up to the present there have been developed thermal transfer recording apparatus of sublimation type and thermal transfer recording apparatus of fusion type, and they have been used properly according to their intended purpose.

A thermal transfer recording apparatus of sublimation type can change the density level of each pixel, and in case of color printing, it can express $n^3$ colors for each pixel when recording each pixel in one of n density levels for each color by means of 3-color ink sheets of cyan, magenta and yellow. In case of recording each pixel in 256 density levels for each color, for example, about 16.7 million colors can be reproduced. Since this type can provide beautiful printing, therefore, this type is often used for image printing. But this type has disadvantages of long printing time, high running cost, and the like.

On the other hand, a thermal transfer recording apparatus of fusion type uses a density pattern method, systematic dither method and the like to obtain a gradated image, since this type expresses each pixel in 2-level (on/off) signals for 3 colors of cyan, magenta and yellow for example, in the case of color printing. The density pattern method obtains pseudogradation of images with variation of pixel area by expressing each pixel with a dot matrix of 2×2 dots, 4×4 dots, or the like, while the systematic dither method, which expresses one pixel with one dot, obtains pseudogradation by arranging each dot in a dither matrix. Therefore, the fusion type is inferior to the sublimation type in expressing gradation, but has advantages that it is shorter in printing time and less expensive in running cost by ⅓ to ⅕ in comparison with the sublimation type.

FIG. 3 is a partial explanatory drawing of heat generating resistive members of a thermal head mounted on a known ink thermal transfer image recording apparatus of sublimation type.

In FIG. 3, a glaze layer (not shown in FIG. 3) of glass is formed on an insulating substrate (not shown in FIG. 3) of alumina or the like, a heat generating resistive film of $Ta_2N$, Ta—$SiO_2$ or the like is formed on the glaze layer by means of vapor deposition, sputtering or the like, and this resistive film is formed into a plurality of rectangular members 3, composed of members 3*a* and 3*b*, aligned in a straight line by means of photoetching. A common electrode 1 is formed commonly to the respective heat generating resistive members 3 on the upper face of them, and individual electrodes 2 are formed respectively on the lower faces of the heat generating resistive members. The other ends of the common electrode 1 and the individual electrodes 2 are respectively connected with terminals of a driving IC (not shown in FIG. 3), and the driving IC outputs signals for individually and selectively driving a plurality of heat generating resistive members 3. Each heat generating resistive member 3 is composed of heat generating resistive members 3*a* and 3*b* which are insulated from each other by a respective slit 4 of insulating material and adjacent heat generating resistive members 3 are insulated from each other by an insulating member 5.

The thermal head has an antioxidant film layer and wear resistant layer not shown in the figure which are formed on the common electrode 1, individual electrodes 2 and the heat generating resistive members 3. Each individual heat generating resistive member 3 forms independently a heat generating element corresponding to one dot of a minimum printing unit. The heat generating element generates heat by applying voltage between the common electrode 1 and associated individual electrode 2.

Such thermal transfer recording apparatus can make a desired printing by pressing the thermal head composed of the heat generating resistive members 3 aligned in a line in a horizontal scanning direction against a sheet of recording paper through an ink sheet, applying a specified signal to an individual electrode 2 corresponding to a desired dot on the basis of specified printing information to make the heat generating resistive member 3 connected with the individual electrode 2 generate heat, and transferring ink from the ink sheet to the recording paper.

FIGS. 4 are explanatory drawings of patterns appearing on a recording paper when recording by means of an ink thermal transfer method of sublimation type, and the patterns are obtained by the thermal head shown in FIG. 3. The thermal head shown in FIG. 3 is made so that a printed dot shape may be longer in the vertical scanning direction, and the relation between M representing dot length in the horizontal scanning direction and S representing dot length in the vertical scanning direction is set as S/M>1. The reason is to prevent occurrence of a hollow of density between printed lines.

FIG. 5 shows the distribution of temperature on a heat generating resistive member 3 of the thermal head shown in FIG. 3. Temperature distribution on one pixel is made flat and sublimative dye is uniformly distributed by dividing the heat generating resistive member 3 into two parts by the slit 4. However, if making the respective dot lengths in the horizontal and vertical scanning directions equal to a desired pixel size as shown by the heat generating resistive members 7 insulatingly divided by a slit 9, temperature distribution in the horizontal scanning direction is made nearly uniform over a pixel area as shown in FIG. 7 (*b*). However, as for temperature distribution in the vertical direction, shown in FIG. 7 (*c*), the difference in temperature between the middle part and the peripheral parts of the heat generating resistive member 7 is increased in a pixel area. As a result, occurrence of a hollow of density between printed lines creates a discontinuity in density when printing an image to be uniform in density so as to significantly deteriorate image quality.

In order to solve this problem, the relation between M representing dot length in the horizontal scanning direction and S representing dot length in the vertical scanning direction is set as S/M>1, and the temperature distribution in this case is as shown in FIGS. 6. If the dot length in the vertical scanning direction is made longer than the desired pixel size (the middle part in the FIG. 6 (*a*)) as shown by the heat generating resistive members 6 insulatingly divided by a slit 8 in FIG. 6 (*a*), the temperature distribution in the horizontal scanning direction shown in FIG. 6 (*b*) is made nearly uniform in a pixel area similarly to FIG. 7 (*b*), and for temperature distribution in the vertical scanning direction also, the difference in temperature between the middle part and peripheral part of the heat generating resistive member 6 is decreased as shown in FIG. 6 (*c*).

FIG. 8 is a partial explanatory drawing of heat generating resistive members of a thermal head of heat concentration type mounted on a known ink thermal transfer image recording apparatus of fusion type. The thermal head is composed of insulating parts 10 each of which is formed as a circular hole, heat generating resistive members 11 separated by insulating strips, a common electrode 12 and individual electrodes 13.

FIGS. 9 are explanatory drawings of patterns appearing on a recording paper when recording by means of an ink thermal transfer method of fusion type, and the patterns are obtained by the thermal head shown in FIG. 8. The thermal head shown in FIG. 8 makes 4 dots in one pixel area with variation of current density in the heat generating resistive member 11 caused by the insulating parts 10 formed as circular holes. As the power applied to an individual electrode 13 increases, the density level of the pixel increases in the manner of an areal density level system in the order shown successively in FIG. 9 (*a*), (*b*) and (*c*).

The fusion type thermal transfer recording method depicted in FIG. 9 is a typical example of this recording mode in which the recording paper is advanced in steps equal to the spacing between adjacent printing lines corresponding to the desired image resolution. Thus, for an image resolution of 150 dpi, the recording paper would be advanced in successive steps each measuring $1/150$ inch.

It is also known to perform fusion type thermal transfer recording by printing sections of a line in sequence and advancing the recording paper by a distance which is a fraction of the spacing between adjacent printing lines corresponding to the desired resolution. By way of example, during a first step, printing of the left half of a line is performed under control of the printing data for that line half, the recording paper is fed by a distance equal to ½ the spacing between two adjacent printing lines, and the right half of the line is then printed, using the printing data provided for that line half, and so on. According to another possibility, the printing of each line is divided into quarters, with the recording paper being fed, between the printing of successive quarters, by a distance equal to one quarter of the spacing between two adjacent lines.

Known thermal transfer recording apparatus of both sublimation type and fusion type whose proper dimensions of heat elements of the thermal head for beautiful printing are different between the sublimation type and fusion type can not be properly used as both types and are composed in combination of thermal transfer recording devices of a simple sublimation type and fusion type in fact.

In other words, since M representing the length of a heat generating element in the horizontal scanning direction and S representing the length of the element in the vertical scanning direction are set as relatively $S/M>1$ to $S/M\approx2$ in the heat generating resistive members of the thermal head used for sublimation type thermal transfer recording, if the same thermal head is used for fusion type thermal transfer recording, ink of an area equivalent to the heat generating element is transferred from the ink sheet to a recording medium to make the dot length too long in the vertical scanning direction, and as a result, line widths become different in the horizontal and vertical scanning directions and deterioration caused by battered dots of pseudogradation made by means of a systematic dither method or the like significantly deteriorates the printing quality. On the other hand, since M representing the length of a heat generating element in the horizontal scanning direction and S representing the length of the element in the vertical scanning direction are set as relatively $S/M\approx1$ in the heat generating resistive members of the thermal head used for fusion type thermal transfer recording, if the same thermal head is used for sublimation type thermal transfer recording, occurrence of a hollow of density between printed lines cause discontinuous density when printing an image which is to be uniform in density and significantly deteriorates the image quality.

SUMMARY OF THE INVENTION

An object of the invention is to provide an image recording method for making possible an ink thermal transfer recording of both sublimation type and fusion type by means of a thermal head usable for ink thermal transfer recording of both sublimation type and fusion type.

Another object of the invention is to provide a thermal transfer recording apparatus of both sublimation type and fusion type which is small in size, inexpensive in cost and easy to use by making its thermal head usable in both recording methods.

In order to solve the above-mentioned problems, the invention provides a thermal transfer recording method for obtaining a desired halftone image by using a thermal head which is composed of heat generating resistive members aligned in a line in a specified direction and whose printed dot length in the vertical scanning direction is equal to or longer than that in the horizontal scanning direction and by changing the amount of heat to be generated in the heat generating resistive members.

In addition, the invention provides a thermal transfer recording apparatus of both sublimation type and fusion type which comprises a paper feeding mechanism for feeding a recording paper by one line with N paper feed control pulses, a thermal head in which the relation between M representing the length of a heat generating element in the horizontal scanning direction and S representing the length of the element in the vertical scanning direction is set as $S/M\approx1$, a printing pulse generating means for generating a printing signal for obtaining a desired density level by being applied to the thermal head, a flag means for detecting the paper feed control pulses and starting the printing pulse generating means, and a means for controlling the printing pulse generating means to generate respectively different printing pulses for the N/2 th and Nth paper feed control pulses during the same line printing period.

As described above, since the invention makes a vertical printing pitch 1/N of one line spacing and prints one line a plurality of times with the same line data as when feeding the paper one printing pitch by one printing pitch in the sublimation type recording mode, it can obtain a printed dot longer in the vertical scanning direction than in the horizontal scanning direction. And since the invention makes the vertical printing pitch equal to the line spacing in the fusion type recording mode, it can obtain a printed dot nearly equal in length in the horizontal and vertical scanning directions.

And the thermal transfer recording apparatus composed as described above can use an ordinary-shaped thermal head as a fusion type thermal head, since the relation between M representing the length of a heat generating element of the thermal head in the horizontal scanning direction and S representing the length of the element in the vertical scanning direction is set as S/M≈1. As a thermal head of sublimation type, the length of its heat generating element in the vertical scanning direction is nearly half the length of the heat generating element of a former thermal transfer recording apparatus simply of sublimation type, but the apparatus of the invention can obtain a printing result with the same pleasing appearance as the former thermal transfer recording apparatus simply of sublimation type by generating the same printing pulses at the time of starting the printing pulse generating means with the N/2 th and Nth paper feed control pulses during the same line printing period.

BRIEF DESCRIPTION OF THE DRAWING

FIGS. 1 (*a*), (*b*) and (*c*) show printed dot areas respectively in case of a small quantity, a medium quantity and a large quantity of energy applied to the thermal head.

FIGS. 2 (*a*), (*b*) and (*c*) show printed dot areas respectively in case of a small quantity, a medium quantity and a large quantity of energy applied to the thermal head.

FIGS. 4 (*a*), (*b*) and (*c*) show printed dot areas respectively in case of a small quantity, a medium quantity and a large quantity of energy applied to the thermal head.

FIGS. 6 are explanatory drawings for explaining the relation between the shape of the heat generating resistive member and temperature distribution. FIGS. 6 (*a*), (*b*) and (*c*) show respectively the shape of the heat generating resistive member, temperature distribution of the heat generating resistive member in the horizontal scanning direction and temperature distribution of the heat generating resistive member in the vertical scanning direction.

FIGS. 7 are explanatory drawings for explaining relation between another shape of the heat generating resistive member and temperature distribution. FIGS. 7 (*a*), (*b*) and (*c*) show respectively the shape of the heat generating resistive member, temperature distribution of the heat generating resistive member in the horizontal scanning direction and temperature distribution of the heat generating resistive member in the vertical scanning direction.

FIGS. 9 (*a*), (*b*) and (*c*) show printed dot areas respectively in case of a small quantity, a medium quantity and a large quantity of energy applied to the thermal head.

FIGS. 12 (*a*), (*b*) and (*c*) show respectively a printing area in the first printing, a printing area in the second printing and the printing area eventually obtained.

DESCRIPTION OF THE PREFERRED EMBODIMENTS

An embodiment of the invention is described in the following, with reference to the drawings.

Figure 10:
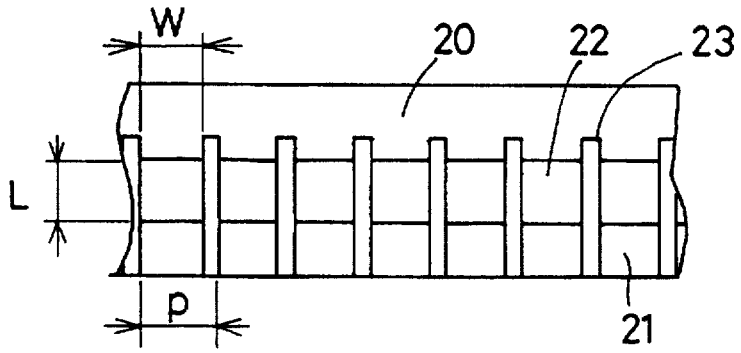
FIG. 10 is a partial explanatory drawing of the heat generating resistive members of the thermal head used in an embodiment of a thermal transfer recording apparatus of the invention.

FIG. 10 is a partial explanatory drawing of heat generating resistive members of a thermal head used in the embodiment of the invention. In FIG. 10, a common electrode 20 and individual electrodes 21 respectively formed on opposite ends of heat generating resistive members 22 are made of a thin or thick film of metal. Adjacent heat generating resistive members 22 are insulated from one another by insulating members 23. Each heat generating resistive member 22 has a dot length of W in the horizontal scanning direction and a dot length of L in the vertical scanning direction. In the embodiment, each heat generating resistive member 22 has a relation of W≈L.

Figure 1:
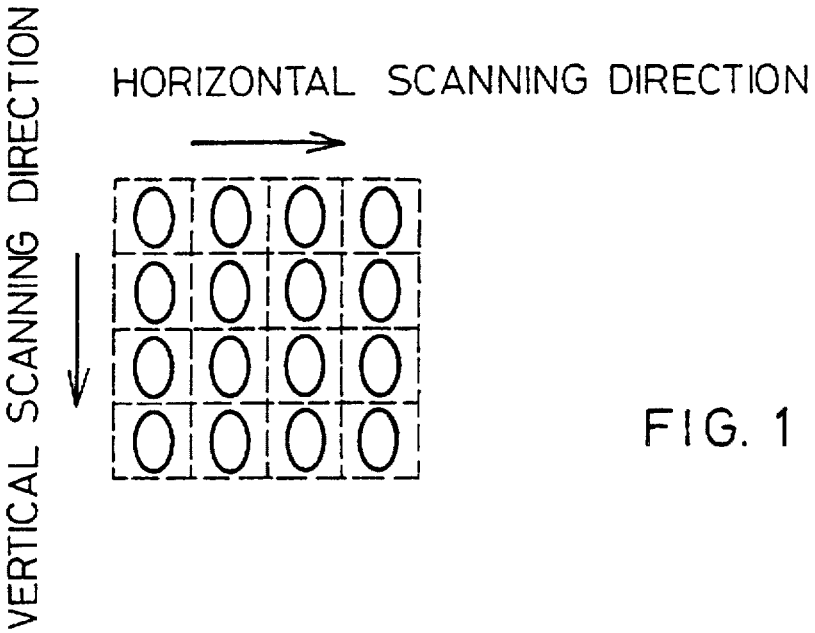
FIGS. 1 are explanatory drawings of printed dot patterns formed in case of using the sublimation type recording mode in a thermal transfer recording method of the invention.
Figure 1:
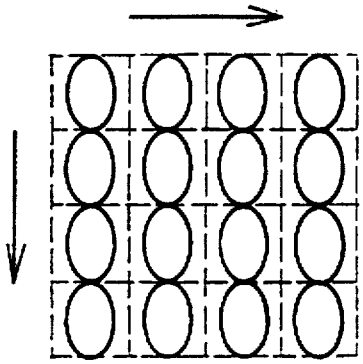
Figure 1:
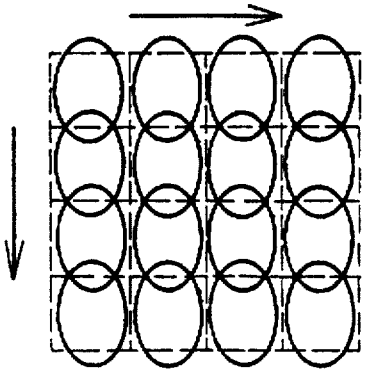

FIGS. 1 are explanatory drawings showing printed dot patterns formed by means of the thermal head shown in FIG. 10 of the embodiment of the invention, where the dots are printed in the sublimation type recording mode, selected from the sublimation type and fusion type recording modes.

The vertical printing pitch in the sublimation type recording mode is set as 1/N (N: an integer equal to or greater than 2) of the vertical printing pitch in the fusion type recording mode. The vertical printing pitch in the sublimation type recording mode is equivalent to 1/N of a distance between two adjacent lines determined for a desired resolution. Assuming N=4, for example, in order to output an image of 150 dpi (dpi is an abbreviation of dots/inch), the vertical printing pitch is set at a spacing with which printing is performed at a rate of 600 lines per inch.

Figure 11:
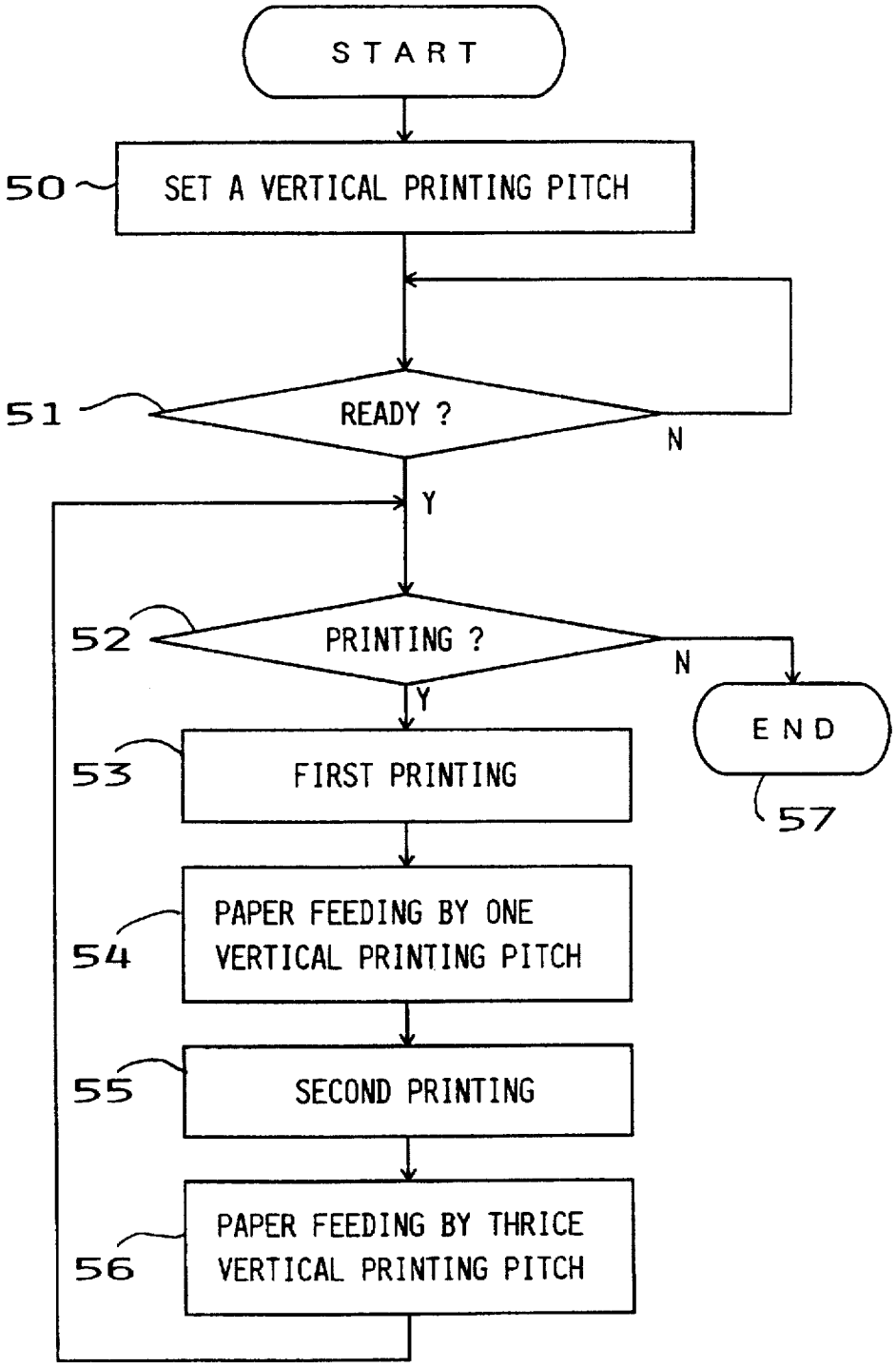
FIG. 11 is a flow chart showing a printing sequence in case of recording an image in the sublimation type recording mode by a thermal transfer recording method of the invention.

Referring to FIG. 11, a printing sequence in the sublimation type recording mode is shown in detail. This is a case of outputting an image of 150 dpi, where the vertical printing pitch in the sublimation type recording mode is assumed to be ¼ of the pitch in the fusion type recording mode.

FIG. 11 is a flow chart showing an example of printing sequences in the sublimation type recording mode. When the sublimation type recording mode is selected, step 50 is executed to set the vertical printing pitch. The distance between two adjacent lines is 169 μm in case of 150 dpi, and the vertical printing pitch is obtained by dividing this distance between lines into quarters, which is equivalent to about 42 μm.

In step 51, the process waits for preparation for printing, such as positioning of a recording paper and an imprinting film and the like, to be completed. When the preparation is completed, the process proceeds to step 52.

In step 52 the number of lines to be printed is counted and when a desired number of lines has finished being printed, the process finishes the printing operation to proceed to step 57. When the number of printed lines does not reach to the desired value, the process proceeds to step 53.

Figures 12A, 12B, 12C:
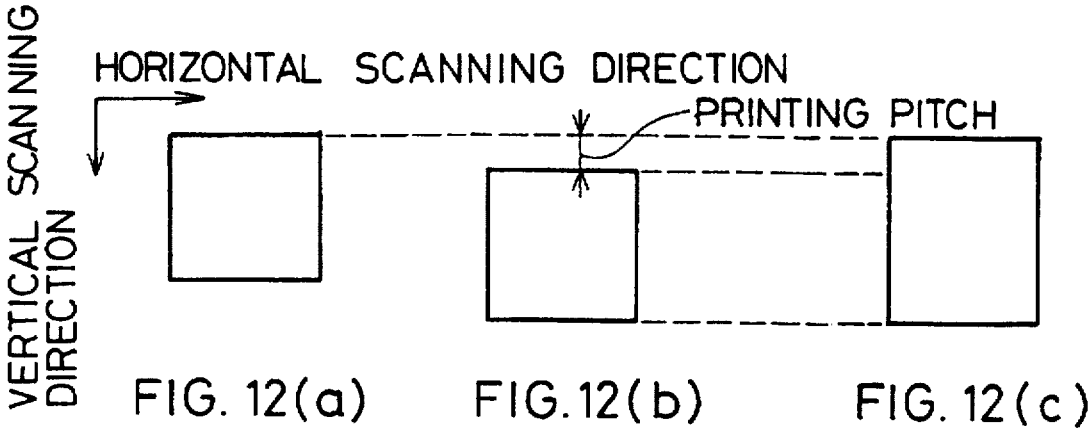
FIGS. 12 are explanatory drawings showing printing areas printed in the printing sequence shown in FIG. 11.

In step 53, a first printing is performed. FIG. 12 (*a*) shows an area of an arbitrary pixel to be printed where ink can be imprinted by the first printing.

In step 54, the recording paper is fed by one vertical printing pitch of 42 μm without printing.

In step 55, a second printing is performed. FIG. 12 (*b*) shows an area of the arbitrary pixel to be printed where ink can be imprinted by the second printing. Namely, the total area of the pixel where ink can be imprinted is made long in the vertical scanning direction by the second printing as shown in FIG. 12 (*c*).

In step 56, the recording paper is fed by three times the vertical printing pitch to prepare for printing the next line. Printing of one line is finished with this.

In this manner, the shape of a printed dot is made longer by about 42 μm by making a second printing at a position vertically shifted by one vertical printing pitch with the same image data as an image printed in a first printing in order to obtain a printing result corresponding to one line. As energy applied to the thermal head in FIG. 10 is increased, the area of the printed dot is spread larger in the order of FIGS. 1 (*a*), (*b*) and (*c*) so as to cause adjacent pixels to overlap each other in the vertical scanning direction. The overlapped area can be controlled by changing the distance of shifting to the second printing position from the first printing position. For example, the shape of the printed dot is made longer by about 84 μm in the vertical scanning direction by making the second printing at a position vertically shifted from the first printing position by double the vertical printing pitch from the first printing position. In this manner, the distance to be shifted can be easily set by appropriate selection of the number of vertical printing pitches. And the number of printing operations for one line can be freely set without being limited to two.

In further accordance with the invention, the successive printings in the sublimation type printing mode are performed based on respectively different printing data for each printing. For example, the first printing can be performed under control of image data for the associated printing line and the second printing can be performed under control of printing data derived by combining image data for the associated printing line and the following printing line. The printing data for the second printing may be an average value or a weighted mean value of the image data for the two printing lines. The weighting can be based on the relative magnitude of the movement of the paper between the first and second printings, i.e. during step 54 of FIG. 11.

Further, a larger number of printings can be performed with respect to each printing line. That is, when the vertical printing pitch is 1/N, up to N printings can be performed for each printing line. The printing data for each printing can be derived as interpolated values which depend on the number of the printing, i.e. first, second, up to Nth. The printing data for the second or subsequent printings can be the same as, or different from, each other. The various mean values or interpolated values can be based on linear or nonlinear functions.

Figure 2:
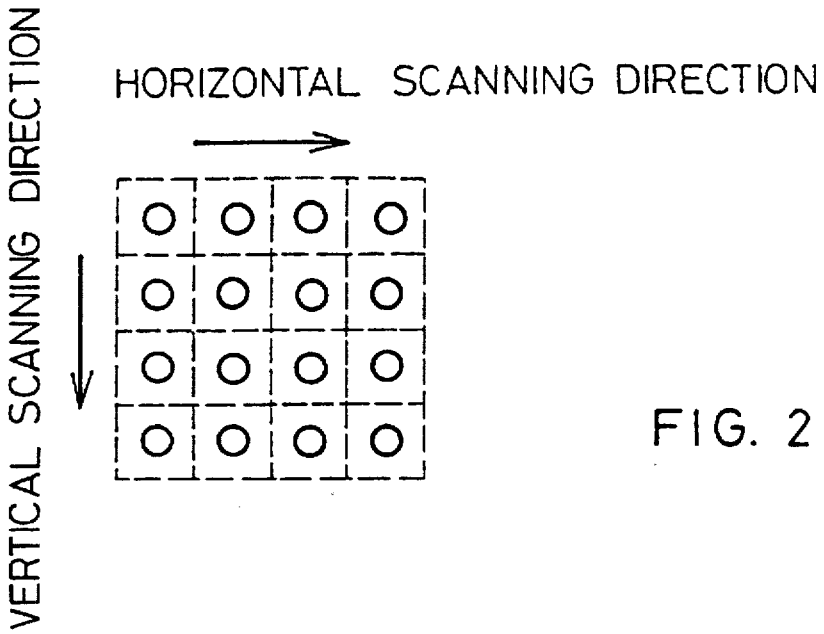
FIGS. 2 are explanatory drawings of printed dot patterns formed in case of using the fusion type recording mode in a thermal transfer recording method of the invention.
Figure 2:
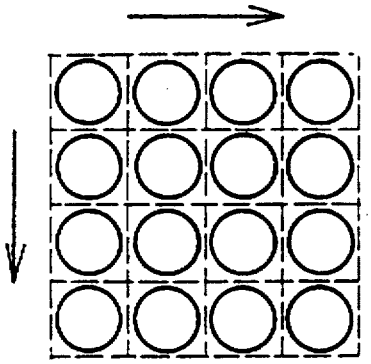
Figure 2:
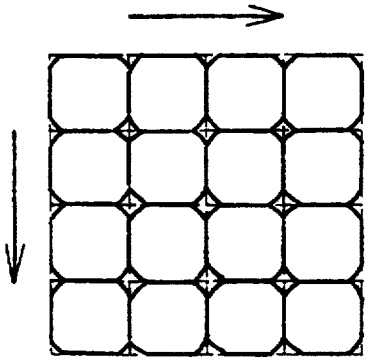
Figure 3:
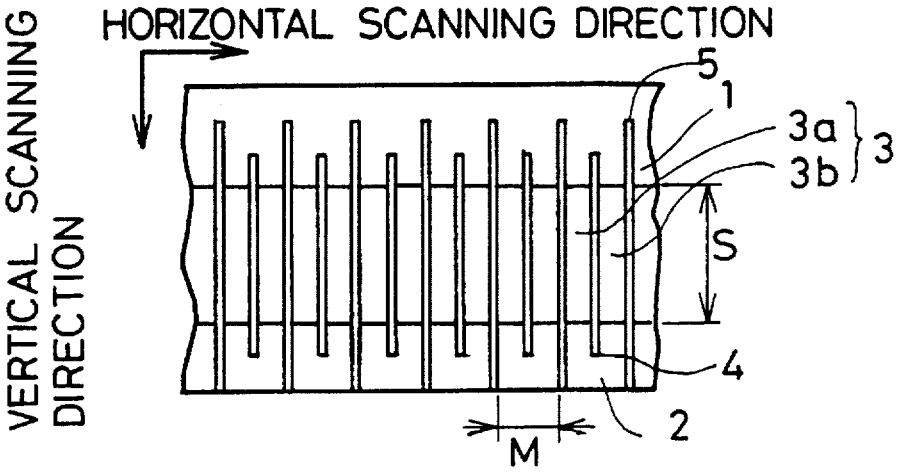
FIG. 3 PRIOR ART
FIG. 3 is a partial explanatory drawing of heat generating resistive members of the thermal head mounted on a prior art thermal transfer recording apparatus of sublimation type.
Figure 4:
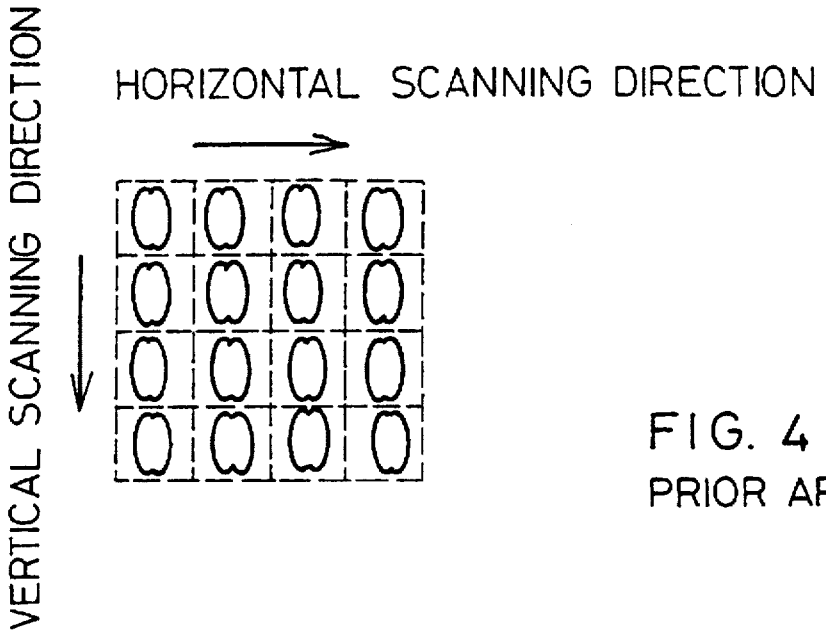
FIG. 4 (a) PRIOR ART
FIGS. 4 are explanatory drawing of printed dot patterns formed in case of recording an image by means of former thermal transfer recording apparatus of sublimation type.
Figure 4:
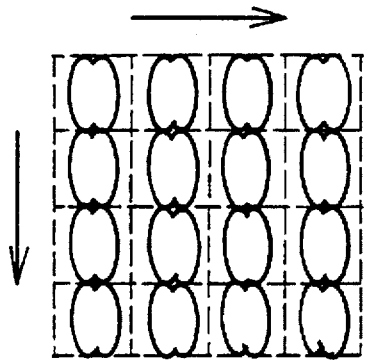
FIG. 4 (b) PRIOR ART
Figure 4:
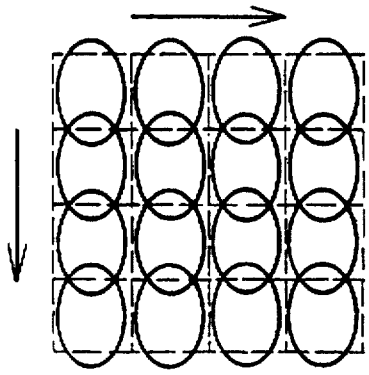
FIG. 4 (c) PRIOR ART
Figure 5:
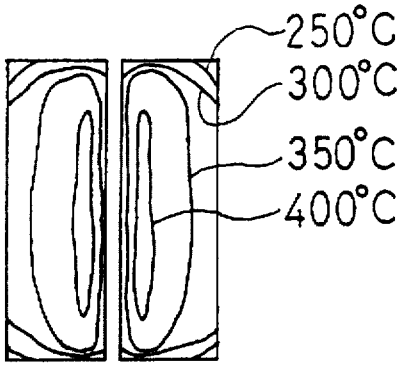
FIG. 5 is an explanatory drawing of temperature distribution in a heat generating resistive member of the thermal head shown in FIG. 3.
Figure 8:
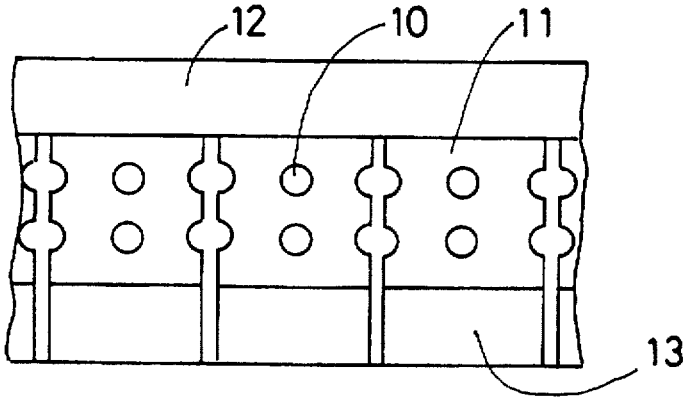
FIG. 8 PRIOR ART
FIG. 8 is a partial explanatory drawing of the heat generating resistive members of the thermal head mounted on a prior art thermal transfer recording apparatus of fusion type.
Figure 9:
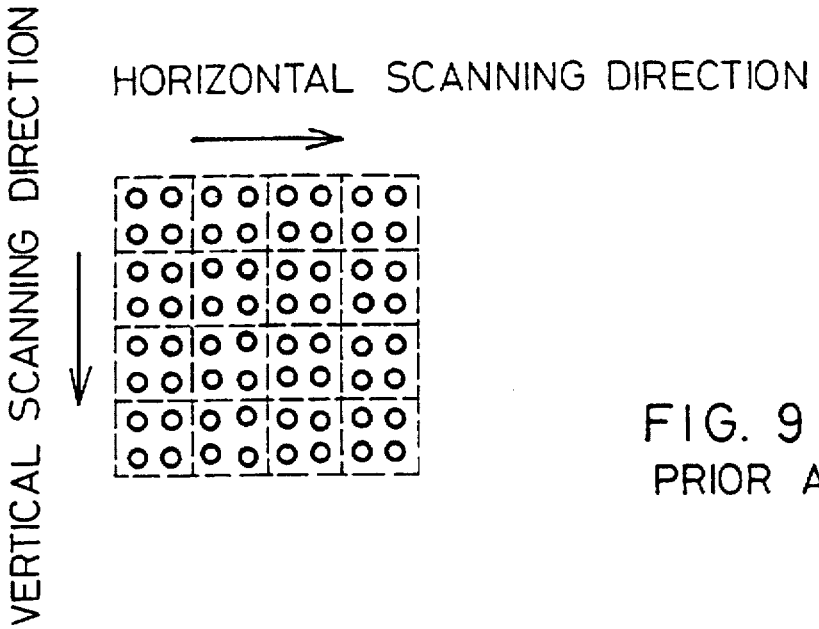
FIG. 9 (a) PRIOR ART
FIGS. 9 are explanatory drawings of printed dot patterns formed in case of recording an image by means of a prior art thermal transfer recording apparatus of fusion type.
Figure 9:
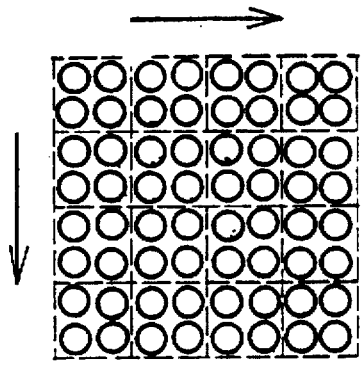
FIG. 9 (b) PRIOR ART
Figure 9:
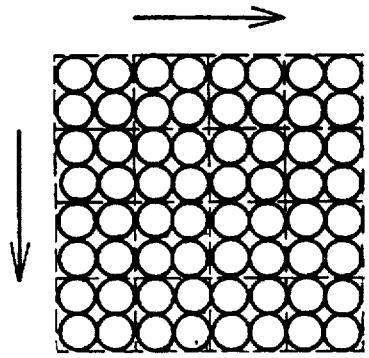
FIG. 9 (c) PRIOR ART

FIGS. 2 are explanatory drawings of printed dot patterns formed in another embodiment of the invention, where the dot patterns are printed in the fusion type recording mode selected from the sublimation type and fusion type recording modes.

The vertical printing pitch in the fusion type recording mode is equal to the distance between two adjacent lines of an output image, and as energy applied to the thermal head of FIG. 10 is increased, the area of the printed dots is spread larger in the order of FIGS. 2 (*a*), (*b*) and (*c*).

In the invention, the relation between the length W of the heat generating resistive member 22 in the horizontal scanning direction and the length L of the heat generating resistive member 22 in the vertical scanning direction does not need to satisfy relation of W≈L. It will do well that the shape of a printed dot in the sublimation type recording mode is made long in the vertical scanning direction and the shape of a printed dot in fusion type recording mode is nearly equal in length in the horizontal and vertical scanning directions. This can be attained by controlling the vertical printing pitch and the shape of the heat generating resistive member. And a slit or hole also can be made in the heat generating resistive member 22.

The apparatus of the invention can be also used as an apparatus executing only one desired recording method by fixing its recording mode to one of the sublimation type and fusion type recording modes, and furthermore the apparatus can use not only both sublimation type and fusion type recording methods but also both heat sensitive recording and fusion type recording methods or both heat sensitive recording and sublimation type recording methods. And these recording modes can be switched over by detecting input from an operator panel or insertion of a recording paper or imprinting film cassette.

The invention makes it possible for the apparatus to operate selectively in either printing mode of the sublimation type or fusion type recording mode. In the sublimation type recording mode, by making a printed dot longer in the vertical scanning direction than in the horizontal scanning direction, the invention can prevent occurrence of a hollow of density between printed lines and give a good image quality even in case of printing an image to be of uniform density, and as a result it can reproduce a halftone image such as a natural picture and the like with good fidelity. In the fusion type recording mode, by making a printed dot equal in length in the horizontal and vertical scanning directions, the invention can make both line widths in the horizontal and vertical scanning directions equal to each other in case of printing a 2-level image such as characters, line-works and the like, and can reproduce natural characters and line-works. And since the fusion type recording mode is less expensive in running cost and faster in printing speed, it can also be used for test printing for the sublimation type recording mode.

An embodiment of a thermal transfer recording apparatus of the invention is described in the following, with reference to the drawings.

FIG. 10 is an explanatory drawing for showing construction of a thermal head as described above. The shape and dimensions of a heat generating resistive member corresponding to one dot of a minimum printing unit are specified as W×L and the pitch between the heat generating resistive members is shown as P. Values of W, L and P are obtained in the following manner.

If the printing resolution in the horizontal scanning direction is 300 dpi, then P=1 inch/300 dots≈85 μm. W is obtained as about 65 μm by subtracting the width of a slit 23 between the heat generating resistive members 22 from P.

A paper feed per pulse is determined from the printing resolution in the vertical scanning direction. For example, in case of a paper feed mechanism feeding a recording paper by one line with 2 pulses, the paper feed per pulse is set as about 42 μm to set the printing resolution in the vertical scanning direction as 300 dpi.

Length L of the heat generating resistive member in the vertical scanning direction is determined from the paper feed per pulse in the vertical scanning direction and the viewpoint of attractiveness of printing. Now, as described above, it is assumed that the printing resolution in the vertical scanning direction is 300 dpi, a recording paper is fed by one line with 2 pulses, and the paper feed per pulse is 42 μm. Under this condition, a thermal transfer recording apparatus gives a beautiful printing with a length of L=140 to 180 μm in the sublimation type recording mode and gives a preferable printing with a length of L=80 to 120 μm in the fusion type recording mode.

By making length L of the heat generating resistive member 22 of the thermal head 80 to 90 μm in a thermal transfer recording apparatus of 300 dpi, the invention has made it possible to make an optimal printing with an ordinary driving circuit and printing pulses in a fusion type thermal transfer recording apparatus while the invention has succeeded in obtaining a printing as beautiful as that in case of L=140 to 180 μm by making a driving circuit and printing pulses in the following manner in a sublimation type thermal transfer recording apparatus. Thus the invention has made it possible to use a thermal head for both sublimation type recording and fusion type recording.

A driving circuit and printing pulses are described below for the case of a printing operation of sublimation type by means of a sublimation type ink sheet and recording paper.

Figure 13:
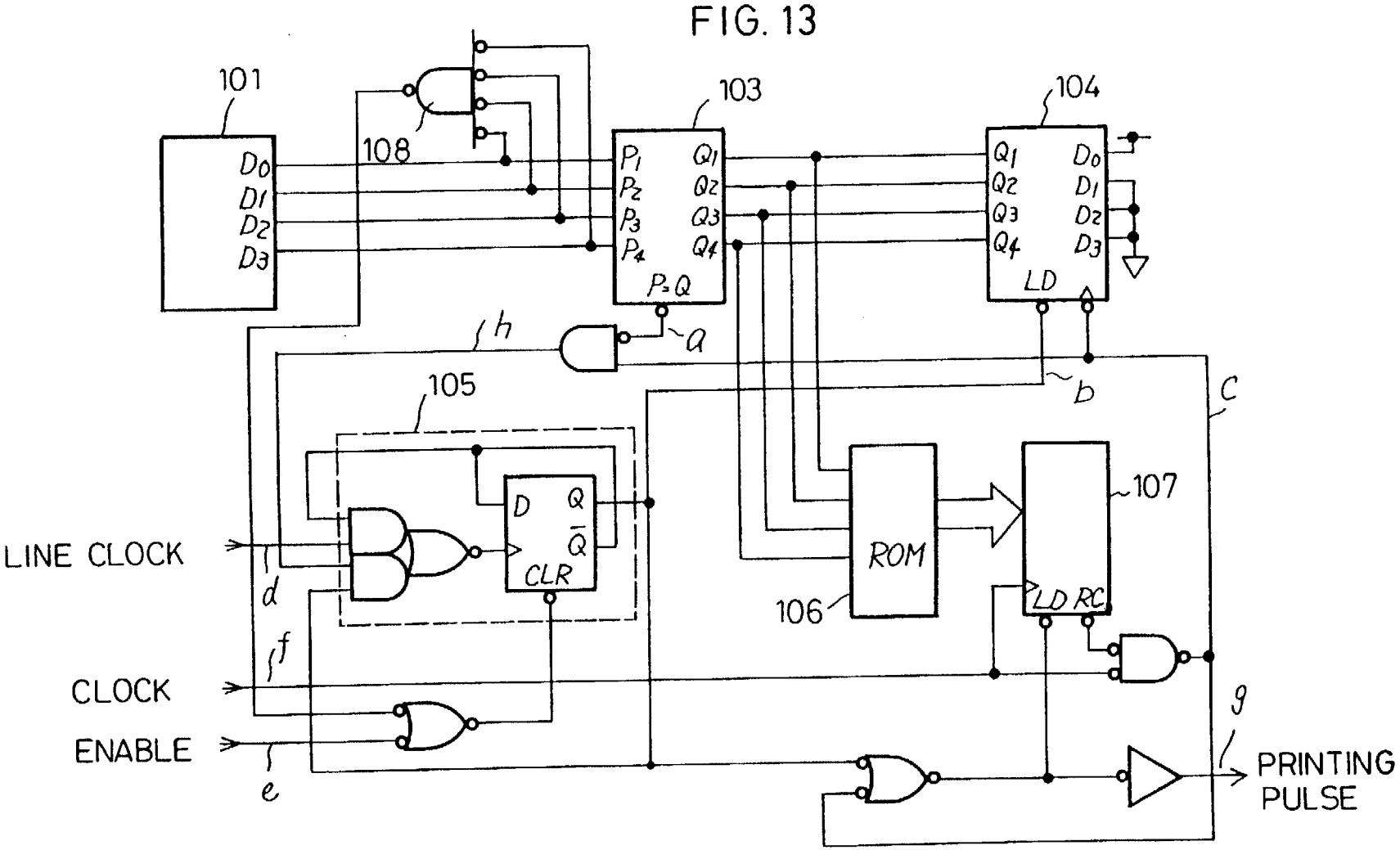
FIG. 13 is a block diagram of a printing pulse generating means of a thermal transfer recording apparatus of the invention.
Figure 14:
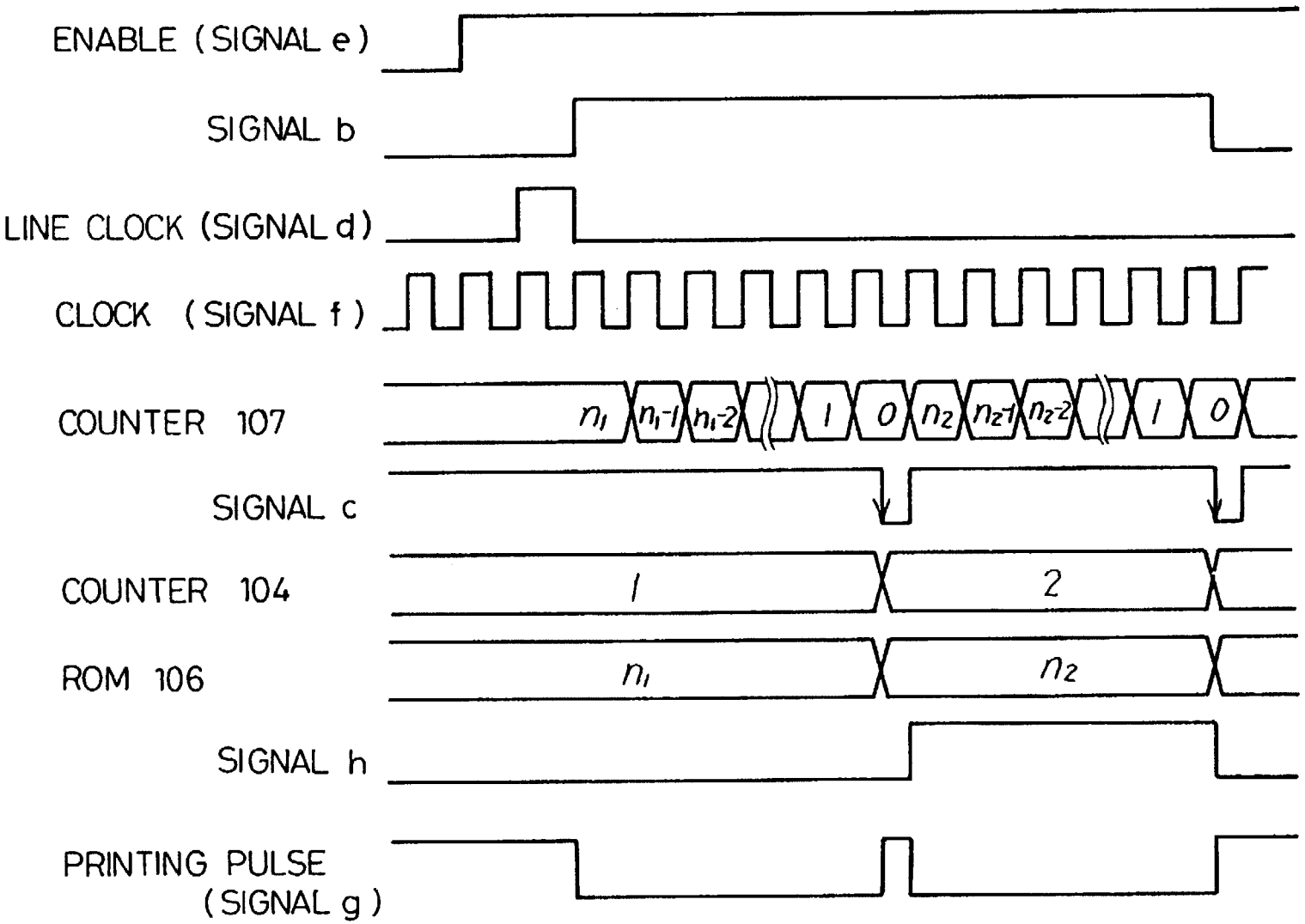
FIG. 14 is a timing chart showing operation of the printing pulse generating means of the thermal transfer recording apparatus of the invention.
Figure 15:
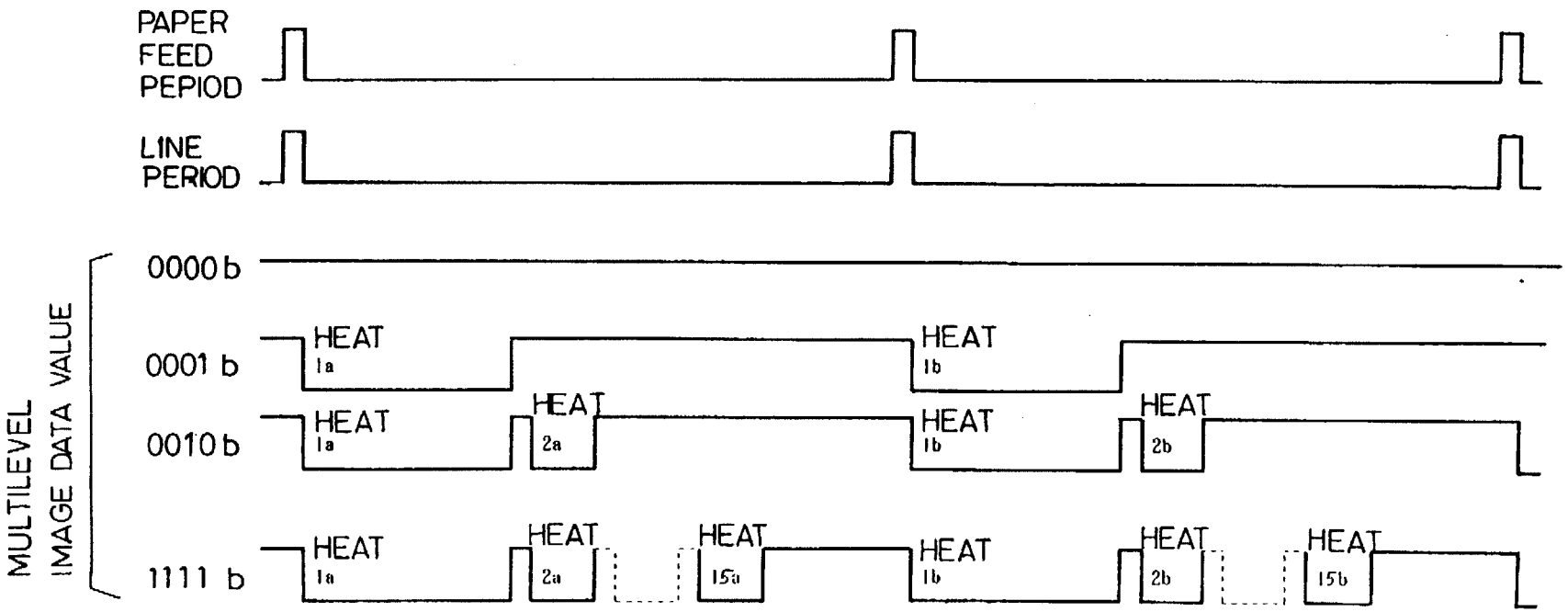
FIG. 15 is a timing chart showing the printing pulses generated by the printing pulse generating means of the thermal transfer recording apparatus of the invention.

FIG. 13 shows a driving signal generating circuit for generating printing pulses to be applied to a thermal head in an embodiment of the invention. FIG. 14 is a timing chart of the driving signal generating circuit, and FIG. 15 is a timing chart of printing pulses generated by the driving signal generating circuit.

The invention is described below, taking as an example a case that resolution of the thermal head is 300 dpi, resolution of the paper feeding in the vertical scanning direction is 300 dpi, and a recording paper is fed by 1 line with 2 pulses.

In FIG. 13, memory 101 is a memory for temporarily storing multilevel image data inputted from a user interface circuit not shown in the figure. One dot of a multilevel image is represented by 8 bits per color for 256 density levels and 4 bits per color for 16 density levels. Since a color image is expressed with 3 colors of cyan, magenta and yellow, one dot of the image needs 24 bits for 256 levels per color and 12 bits for 16 levels per color. FIG. 13 shows a case where each color of one dot is expressed by 4 bits for 16 levels.

Comparator 103 compares outputs of the memory 101 and a counter 104 with each other and sets a coincidence signal a to "0" when the outputs coincide with each other. The counter 104 is an asynchronous load counter which has a presetted initial value $1_H$ (which means 1 in the hexadecimal numeration system, and the same applies hereinafter) loaded according to output signal b of a flag 105 and counts at the falling edge of signal c outputted from a counter 107 after the load state is cleared. The output value of the counter 104 is transferred to the comparator 103 and to a table ROM 106. The flag 105 is cleared by an enable signal e and toggled by a line clock signal d and another signal h.

The signal h is a signal obtained by effecting the AND function of coincidence signal a outputted from the comparator 103 and signal c outputted from the counter 107. The table ROM 106 is a ROM for outputting data corresponding to an address to the counter 107, using a counted value outputted from the counter 104 as the address. The counter 107 is a synchronous counter into which is loaded data outputted from the table ROM 106 as its initial value synchronously with clock signal f, counts the clock signal f after the load signal is cleared, and generates an RC signal when the counting is finished. Gate 108 is a NAND gate which keeps the flag 105 in the initial state not to generate a printing pulse g when data read from the memory 101 is $0_H$.

Operation of the driving signal generating circuit is described in the following, taking as an example a case where a multilevel image data value of 4 bits read from the memory 101 is 0010*b* (which means 2 in the binary numeration system, and the same applies hereinafter). FIG. 14 shows a timing chart at this time.

The enable signal e is "0" in the initial state and at this time the flag 105 is cleared and its output signal b is "0". When the signal b is "0", the counter 104 is in a load state and output of the counter 104 is kept to be $1_H$ as presetted. The output value $1_H$ of the counter 104 is entered into the comparator 103 and the table ROM 106. The table ROM 106 uses the entered value $1_H$ as an address and outputs data n1 at the address 1. When the enable signal e is "0", the output signal b of the flag 105 is "0", and therefore the counter 107 is in the load state and keeps the output value n1 of the table ROM 106.

As shown in FIG. 14, if the line clock signal d is inputted after changing the enable signal e from "0" to "1", the output signal b of the flag 105 changes from "0" to "1" at the falling edge of the line clock signal d. When the signal b comes to "1", the load state of the counters 104 and 107 is cleared and at the same time the printing pulse g changes from "1" to "0" as shown in FIGS. 14 and 15 to generate a printing current pulse called heat 1a to the thermal head.

When the load state is cleared, the counter 107 starts counting the clock signal f and outputs an RC signal when the initially set value has come to zero. The RC signal is turned into a clock signal c of the counter 104 by being ANDed with the clock signal f. When the signal c is "0", the printing pulse g is "1" and shows that the heat 1*a* has ended. At the falling edge of the signal c, the counter 104 counts up, its output value comes to $2_H$ and address 2 of the table ROM 106 is accessed. The signal c is ANDed with the output signal b of the flag 105. Since the signal c is connected with the load terminal of the counter 107, when the signal c is "0" the counter 107 is kept in the load state and data n2 at the address 2 of the table ROM 106 is inputted into the counter 107.

The comparator 103 compares the multilevel image data value 0010*b* with the output value $2_H$ counted up of the counter 104, changes the coincidence signal a from "1" to "0", and turns the signal h to "1" after the signal c has risen up, but the output signal b of the flag 105 is not changed. After the signal c has risen up, the printing pulse g comes to "0" again and generates a printing current pulse called heat 2*a*. At this time, the counter 107 performs the same operation as described above to output an RC signal again after counting the clock signals f by n2. In the same manner as described above, the signal c is turned to "0" by the RC signal, the signal h is turned from "1" to "0", and the output signal b of the flag 105 is changed from "1" to "0". When the signal b is turned to "0", the counters 104 and 107 come into the load state and again the value $1_H$ is loaded into the counter 104 and data n1 at the address 1 of the table ROM 106 is loaded into the counter 107. And the printing pulse g is turned to "1". Thus, the printing current pulses have been generated corresponding to the multilevel image data in the line clock signal d at the first paper feeding pulse.

When the line clock signal d at the second paper feeding pulse is inputted into the flag 105 in this state, the flag 105 is turned over, namely its output signal b is turned from "0" to "1". After this, the circuit performs the same operation as described above and generates printing current pulses heat 1*b* and heat 2*b* corresponding to the multilevel image data as shown in FIG. 15. In the embodiment of the invention, the printing current pulses corresponding to the line clock signal at the second paper feeding pulse is made equal to the printing current pulses corresponding to the line clock signal at the first paper feeding pulse.

After generating the printing current pulses corresponding to the line clock signal d at the second paper feeding pulse, the circuit reads the multilevel image data for the next line from the memory 101 and repeats the above-mentioned operation.

There has been explained a case that the multilevel image data is 0010*b*, but another case of another multilevel image data also can be implemented by reading data stored in the table ROM 106 corresponding to each heat pulse. For example, if the multilevel image data is 1111*b*, then as shown in FIG. 15, printing current pulses heat 1 to heat 15 are generated respectively corresponding to the two line clock signals by reading sequentially data n1 to n15 from the table ROM 106.

In case that the multilevel image data is 0000*b*, the output value of the NAND gate 108 is "0", the flag 105 is in the clear state, and the printing pulse g is kept as "1". Therefore, the thermal head does not make a printing operation.

There has been described a case where one dot of a multilevel image is expressed by 4 bits for each color, but it is not limited to this case.

In a thermal transfer recording apparatus, each dot of one line is given each multilevel image data and a printing pulse corresponding to each multilevel image data is supplied to a heat generating resistive member of a thermal head for each dot. The embodiment makes a 1-line printing by supplying the same printing pulses during two paper feeding periods.

According to other embodiments of the invention, as noted earlier herein, the printing pulses supplied during a plurality of paper feeding periods in the sublimation mode can differ from one another, i.e. the printing pulse pattern for the second and subsequent printings can be different from that during the first printing. For example, the printing pulse pattern for the second printing, and possibly subsequent printings, can be derived by interpolating image data for two successive printing lines.

One specific example of these embodiments will be presented below, it being understood that this is simply an example to which the invention is not limited. In this example, N=2 and printing pulses generated after each even-numbered clock d are based on different data than that used to control the immediately preceding printing.

To describe this embodiment, the output from memory 101 is identified as printing data PD which is derived from image data md. Both the printing data PD and the image data md are multi-bit data words, each consisting of four bits in this example. The printing data bits are supplied to outputs $D_0$–$D_3$ of memory 101. Each printing data word determines the printing pulse pattern for one pixel. The printing data words for all pixels in one row, i.e. in the horizontal scanning direction, will be generated in the same manner. The following description will be based on the assumption that the circuit of FIG. 13 provides printing pulses for one pixel in each row in the horizontal scanning direction, i.e. for one column of pixels in the vertical scanning direction.

At the time of a first line clock signal d0, the image data in memory 101 is md0 and is the image data for a first printing line, and the printing data is PD0=md0.

For the second printing after the second line clock signal d1, PD1=(½)md0+(½)md1, where md1 is the image data for a second printing line and the plus sign (+) represents algebraic addition. PD1 is the printing data for the second printing.

For a third printing after a third line clock signal d2, the printing data for the third printing is:

$$PD2=md1.$$

For a fourth printing after a fourth line clock signal d3, the printing data for the fourth printing is:

$$PD3=(½)md1+(½)\ md2,$$

where md2 is the image data for a third printing line.

Further printing continues according to the same pattern. Thus, different printing data can be provided for each line.

The following listing shows the value of printing data when N=4 and each recording paper feeding step is equal to the printing pitch:

| | |
|---|---|
| PD0 = (⅝)md0 | PD1 = (⅞)md0 |
| PD2 = (⅞)md0 + (⅛)md1 | PD3 = (⅝)md0 + (⅜)md1 |
| PD4 = (⅜)md0 + (⅝)md1 | PD5 = (⅛)md0 + (⅞)md1 |
| PD6 = (⅞)md1 + (⅛)md2 | PD7 = (⅝)md1 + (⅜)md2 |
| PD8 = (⅜)md1 + (⅝)md2 | PD9 = (⅛)md1 + (⅞)md2 |
| PD10 = (⅞)md2 + (⅛)md3 | PD11 = (⅝)md2 + (⅜)md3 |

Another version of this embodiment is described in the following table:

| Line Clock Signal # | Printing Data |
|---|---|
| d0 | PD0 = (¾)md0 |
| d1 | PD1 = (¾)md0 + (¼)md1 |
| d2 | PD2 = (¼)md0 + (¾) md1 |
| d3 | PD3 = (¾)md1 + (¼)md2 |
| d4 | PD4 = (¼)md1 + (¾)md2 |
| d5 | PD5 = (¾)md2 + (¼)md3 |

In the above table, md0, md1, md2 and md3 are the image data for four successive printing lines corresponding to the fusion type mode printing lines.

The above-described interpolations can be performed in memory 101, or in a separate interpolation circuit (not shown).

Figure 16:
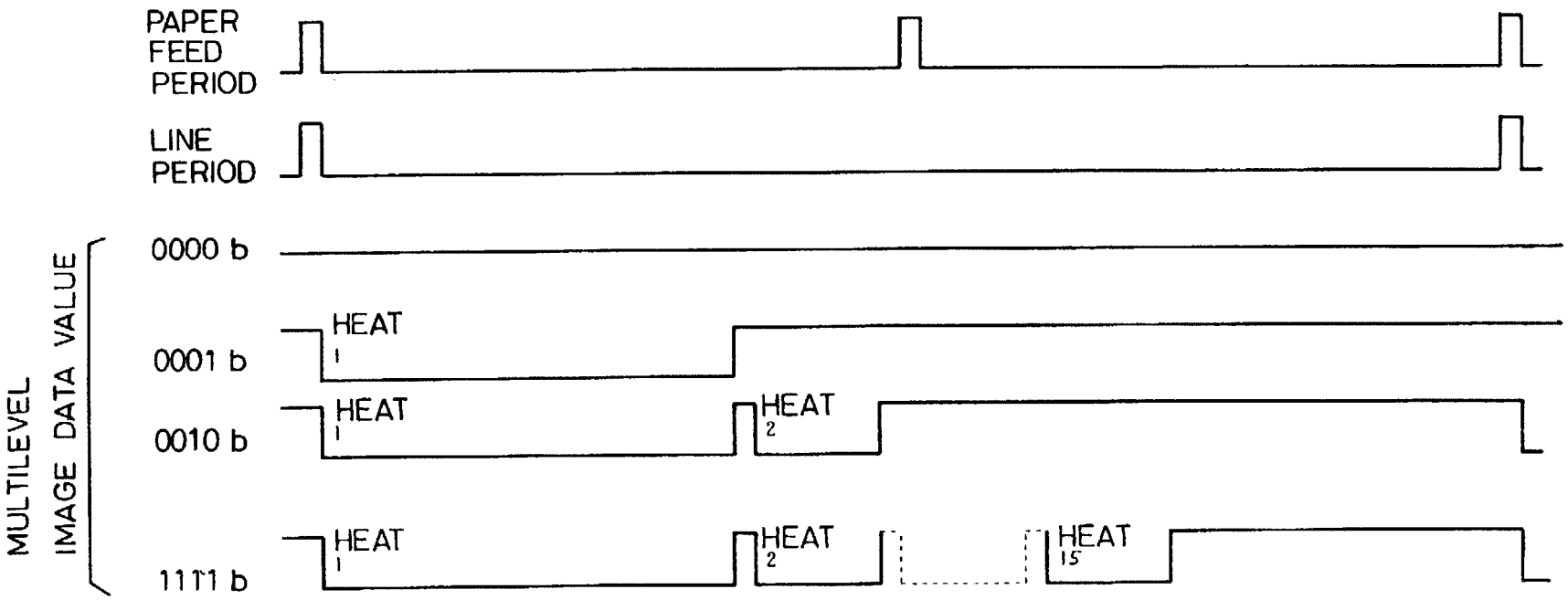
FIG. 16 PRIOR ART
FIG. 16 is a timing chart showing the printing pulses in a prior art thermal transfer recording apparatus.

For reference, FIG. 16 shows the relation between printing pulses and paper feeding periods in a prior art thermal transfer recording apparatus, wherein a case of using a heat generating resistive member whose length is 150 to 180 μm in the vertical scanning direction is described and printing pulses are generated over two line clock signals for paper feeding. In case of using a heat generating resistive member whose length is 80 to 90 μm in the vertical scanning direction as the invention, a method for supplying the printing pulses as shown in FIG. 16 does not bring a sufficient result of printing.

A thermal transfer recording apparatus of the invention can use a thermal head in both sublimation type and fusion type recording modes, since the apparatus is composed of a thermal head in which the relation between the length M of its heat generating resistive member in the horizontal scanning direction and the length S of its heat generating resistive member in the vertical scanning direction is set as $S/M \approx 1$, a printing pulse generating means for generating pulses for obtaining a desired density level by being applied to the thermal head, a flag means for starting the printing pulse generating means by detecting a paper feed control pulse, and a control means for generating the same printing pulse for the N/2th and Nth paper feed control pulses in the same line. This has made it possible to implement an inexpensive and high-performance thermal transfer recording apparatus usable in both sublimation type and fusion type recording modes.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A thermal transfer recording method of a thermal transfer recording apparatus which uses a thermal head composed of heat generating resistive members aligned in a specified direction, obtains a desired halftone or color image by changing heat quantity generated in the heat generating resistive members, and is constructed to selectively switch over its recording mode to a selected recording mode selected from a sublimation type thermal transfer recording mode and a fusion type thermal transfer recording mode, said method comprising performing printing in the sublimation type thermal transfer recording mode by the steps of:

a) determining a printing pitch for the sublimation type thermal transfer recording mode;

b) performing a first printing on a recording paper in accordance with selected printing data;

c) feeding the recording paper by a distance equal to an integral multiple of the determined printing pitch, wherein the integral multiple is $\geqq 1$;

d) performing a second printing in accordance with selected printing data different from the selected printing data in accordance with which said first printing is performed; and e) feeding the recording paper by a distance equal to an integral multiple of the determined printing pitch, wherein the integral multiple is $\geqq 1$.

2. A thermal transfer recording method as defined in claim 1 wherein recording in the sublimation type thermal transfer recording mode is effected by repeatedly performing steps b to e after once performing steps a to e.

3. A thermal transfer recording method as defined in claim 2 wherein an image printed in the sublimation type thermal transfer recording mode is composed of a plurality of dots arranged in parallel lines perpendicular to the direction of said feeding steps, with adjacent lines being offset from one another by a line spacing, the line spacing is equal to an integral multiple, $\geqq 2$, of the printing pitch, and the distance by which the recording paper is fed during each said feeding step is less than the line spacing.

4. A thermal transfer recording method as defined in claim 1 wherein an image printed in the sublimation type thermal transfer recording mode is composed of a plurality of dots arranged in parallel lines perpendicular to the direction of said feeding steps, with adjacent lines being offset from one another by a line spacing, the line spacing is equal to an integral multiple, $\geqq 2$, of the printing pitch, and the distance by which the recording paper is fed during each said feeding step is less than the line spacing.

5. A thermal transfer recording method as defined in claim 1 comprising the further steps of performing at least one further printing in accordance with selected printing data different from the selected printing data in accordance with which said first printing is performed, and after each at least one further printing feeding the recording paper by a distance equal to an integral multiple of the determined printing pitch, wherein the integral multiple is $\geqq 1$.

6. A thermal transfer recording method as defined in claim 1 further comprising performing printing in the fusion type thermal transfer recording mode to produce an image having a selected resolution, by the steps of:

printing a line of an image on a recording paper; and feeding the recording paper by a distance corresponding to the selected resolution; and repeating said steps of printing and feeding in sequence a plurality of times.

7. A thermal transfer recording apparatus usable in both a sublimation type recording mode and a fusion type recording mode, for producing a visible recording on a recording paper, which comprises:

a paper feeding means for feeding the recording paper by one line of image printing in a first scanning direction with N paper feed control pulses, where N is an integer greater than 1;

a thermal head which has a plurality of heat generating resistive members, with all of said heat generating resistive members having substantially equal dimensions in the first scanning direction and in a second scanning direction perpendicular to the first scanning direction;

a printing signal generating means for generating signals for application to said thermal head for producing a desired halftone or color image on the recording paper; and a flag means connected for operating said printing signal generating means a plurality of times during a 1-line printing period by detecting the paper feed control pulses, wherein said printing signal generating means generates new signals after at least one operation effected by said flag means.

8. A thermal transfer recording apparatus as defined in claim 7 wherein the printing signal generating means generates different printing signal after the N/2th and Nth paper feed control pulses, respectively, during a 1-line printing period.

9. A thermal transfer recording apparatus as defined in claim 7 wherein said flag means starts said printing signal generating means twice during a 1-line printing period.

10. A thermal transfer recording apparatus as defined in claim 7 wherein each said heat generating resistive member has a length of 80 to 90 μm in the first scanning direction.

* * * * *